United States Patent [19]

Oppenberg

[11] Patent Number: 4,862,835

[45] Date of Patent: Sep. 5, 1989

[54] COMBUSTION SYSTEM FOR BURNING HEAVY HEATING OIL WITH LOW NOX

[75] Inventor: Rolf Oppenberg, Wesel, Fed. Rep. of Germany

[73] Assignee: Deutsche Babcock Werke Aktiengesellschaft, Oberhausen, Fed. Rep. of Germany

[21] Appl. No.: 257,994

[22] Filed: Oct. 14, 1988

[30] Foreign Application Priority Data

Nov. 4, 1987 [DE] Fed. Rep. of Germany ..... 3737321

[51] Int. Cl.[4] ..... F22B 5/00

[52] U.S. Cl. ..... 122/17; 110/204; 431/115

[58] Field of Search ..... 110/203, 204, 216; 431/115, 116; 122/142, 177, 167, 17, 14

[56] References Cited

U.S. PATENT DOCUMENTS

| | | | |
|---|---|---|---|
| 3,868,211 | 2/1975 | Haye et al. | 431/115 X |
| 3,880,570 | 4/1975 | Marshall | 431/115 X |
| 3,957,418 | 5/1976 | Sata | 431/115 X |
| 4,699,071 | 10/1987 | Vier et al. | 110/204 X |

*Primary Examiner*—Edward G. Favors
*Attorney, Agent, or Firm*—Max Fogiel

[57] ABSTRACT

A flame-tube boiler is provided with a system of burners for the low-$NO_x$ combustion of heavy oil, with an air box (8) that communicates with the cooled flame tube (1) by way of a central primary-air channel (16) that surround an oil-burner lance (17) and by way of secondary-air feeds (18) that surround the primary-air channel. The flue-gas line (19) communicates with the flue-gas outlet (7) and accommodates a precipitator (20), which has a solids outlet that communicates with a ring of nozzle pipes (24) inside the burner and opening into the flame tube.

9 Claims, 1 Drawing Sheet

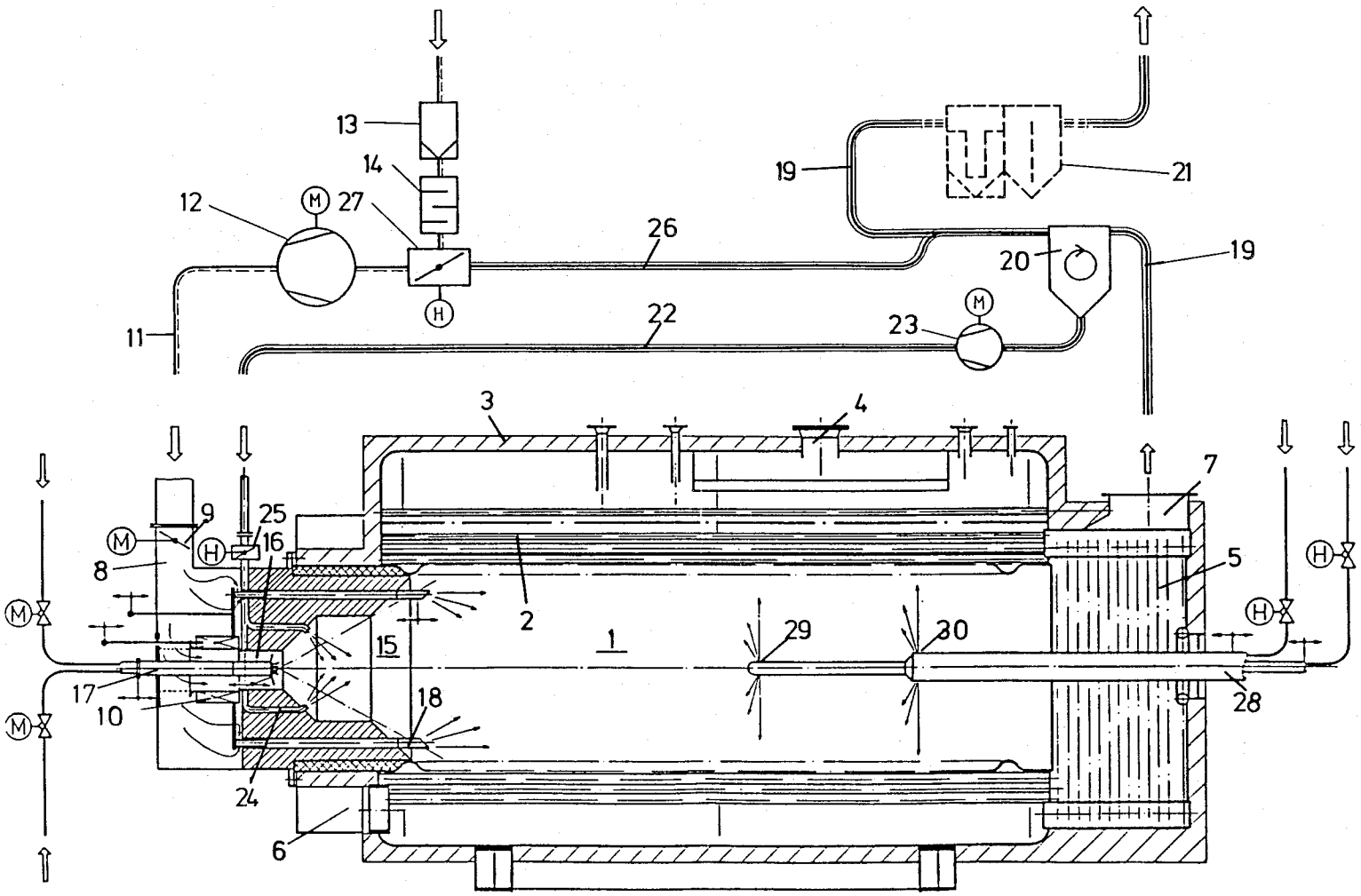
1
2
3
4
5
6
7
8
9
10
11
12
13
14
15
16
17
18
19
19
20
21
22
23
24
25
26
27
28
29
30

COMBUSTION SYSTEM FOR BURNING HEAVY HEATING OIL WITH LOW NOX

The invention concerns a system of burners for the low-$NO_x$ combustion of heavy oil in a flame-tube boiler with the characteristics recited in the preamble to claim 1.

A system of burners of this type is known, from German Patent No. 2 731 562 for example. Problems occur in the system when the burner is operated with heavy oil and employed to heat a flame-tube boiler. The oil does not burn completely in the flame tube, which is cooled from all sides, especially when the process is carried out with a low surplus of air and a graduated supply of air in order to suppress the formation of $NO_x$.

The object of the invention is to improve the generic system of burners to the extent that the oil will burn completely and the formation of $NO_x$ will still be suppressed.

This object is attained in accordance with the invention in a generic system of burners by means of the characteristics recited in claim 1. Advantageous embodiments of the invention are recited in the subsidiary claims.

Such coarse dust components as ash and uncombusted particles are precipitated in a precipitator in the flue-gas line and returned to the burner for reburning, allowing a certain percentage of uncombusted particles to be present during the combustion process.

One embodiment of the invention is illustrated in the drawing and will now be specified. The drawing represents a flame-tube boiler with a system of burners in accordance with the invention.

The boiler is a large-waterspace boiler and consists of a flame tube 1 and of internal flues 2 accommodated in a pressurization jacket 3. Jacket 3 is provided with a water intake and a connection 4 for removing saturated steam. Internal flues 2 communicate by way of a rear return chamber 5 and a forward return chamber 6 and extend into a flue-gas outlet 7. Flanged to flame tube 1 is a burner that communicates with an air box 8 for the supply of combustion air. There is a regulating flap 9 at the entrance into air box 8. Accommodated inside the air box is an axially movable swirl generator 10. An air line 11 that accommodates a fresh-air nozzle 12 opens into air box 8. The nozzle injects air by way of a filter 13 and a noise muffler 14.

The burner has a fireproof-clad chamber 15 that expands discontinuously and accommodates a central primary-air channel 16 that connects air box 8 to flame tube 1. Extending through air box 8 and primary-air channel 16 is an oil-burner lance 17 that is supplied with heavy oil. The position of the lance can be varied inside primary-air channel 16 by means of rods.

Central primary-air channel 16 is surrounded by secondary-air feeds 18 that extend through the wall of chamber 15 and open into flame tube 1 at an axial distance from the outlet cross-section of primary-air channel 16. The ends of secondary-air feeds 18 extend out of chamber 15 and can be axially displaced by means of rods.

A flue-gas line 19 is connected to the boiler's flue-gas outlet 7 and leads to an unillustrated chimney. Accommodated in flue-gas line 19 are a precipitator 20, preferably a centrifugal-force precipitator, and a compactor 21 for removing residual dust, sulfur, and nitrogen.

The solids outlet from precipitator 20 communicates with the burner by way of a line 22 that accommodates a flue-gas fan 23. Line 22 extends up to a passage consisting of a ring of nozzle pipes 24 in the wall of chamber 15. A single nozzle or an annular channel can be employed instead of nozzle pipes. Nozzle pipes 24 are distributed along the arc of a circle between primary-air channel 16 and secondary-air feeds 18. The outlet cross-section of nozzle pipes 24 extends along the longitudinal axis of the burner, downstream of the outlet cross-section of primary-air channel 16 and upstream of the outlet cross-section of secondary-air feeds 18. There is a cutoff 25 in line 22 upstream of the entrance into the burner.

Flue-gas fan 23 suctions a mixture of flue gas and coarse particles of dust out of the solids outlet of precipitator 20. In addition to ash, the mixture contains uncombusted particles that are pumped back into the burner and reburned. The jets that emerge from nozzle pipes 24 extend at an angle in three-dimensional space to the axis of the burner, generating a rotation.

A branch line 26 diverges from precipitator 20, which communicates with the gas outlet. A subsidiary flow of flue gas is supplied by way of branch line 26 and of a gas-volume regulating flap 27 to air box 8. The recirculated gas is mixed with the combustion air and pumped through primary-air channel 16 and secondary-air feeds 18 into flame tube 1.

A cooled lance 28 extends into the end of flame tube 1 that is remote from the burner. The lance is provided with outlet openings 29 and 30, through which additional fuel and additional air are introduced into the tube. The outlet openings 29 that supply the additional fuel extend farther into flame tube 1 than the outlet openings 30 that supply the additional air. The purpose of the additional fuel and air is to decrease the nitrogen oxides that form in the flame.

I claim:

1. A system of burners for low $NO_x$ combustion of heavy oil comprising: a flame tube boiler with a cooled flame tube; a flue-gas outlet and a flue-gas line communicating with said flue-gas outlet; a burner positioned at one end of said flame tube and having an air box; a central primary air channel and secondary air feeds surrounding said primary air channel, said air box communicating with said flame tube through said primary air channel and said secondary air feeds; an oil-burner lance extending through said primary air channel; a precipitator accommodated by said flue-gas line and having a solids outlet communicating with a passage inside said burner and opening into said flame tube.

2. A system as defined in claim 1, wherein said passage comprises a nozzle.

3. A system as defined in claim 1, wherein said passage comprises a crown of nozzle pipes.

4. A system as defined in claim 1, wherein said passage comprises an annular channel.

5. A system as defined in claim 1, wherein said passage has a diameter longer than that of said central primary air channel, said secondary air feeds being distributed along an arc of a circle, said diameter of said passage being shorter than that of said arc of said circle.

6. A system as defined in claim 1, wherein said secondary air feeds have an outlet cross-section wider than that of said passage, said passage having an outlet cross-section wider than that of said primary air channel in said flame tube.

7. A system as defined in claim 1, including a branch line, said precipitator having a gas outlet communicating with said air box through said branch line.

8. A system as defined in claim 1, wherein said precipitator comprises a centrifugal-force precipitator.

9. A system as defined in claim 1, including a lance extending into an end of said flame tube remote from said burner for supplying additional fuel and air.

* * * * *